United States Patent [19]

Crane

[11] 3,946,915

[45] Mar. 30, 1976

[54] GARMENT HANGER WITH CLAMP GUARD

[75] Inventor: Walton B. Crane, Sherman Oaks, Calif.

[73] Assignee: A & E Plastik Pak Co., Inc., City of Industry, Calif.

[22] Filed: Dec. 5, 1974

[21] Appl. No.: 529,616

[52] U.S. Cl. ..... 223/96

[51] Int. Cl.[2] ..... A47J 51/14

[58] Field of Search ..... 223/95, 96, 91; 211/89, 211/124

[56] References Cited

UNITED STATES PATENTS

| | | | |
|---|---|---|---|
| 648,534 | 1/1900 | Seger | 223/96 |
| 1,458,552 | 6/1923 | Shee | 223/96 |
| 2,828,898 | 4/1958 | Hulett | 223/96 |

*Primary Examiner*—George H. Krizmanich
*Attorney, Agent, or Firm*—Forrest J. Lilly

[57] ABSTRACT

The disclosure is of a trousers or skirt hanger comprising a horizontal beam provided with a support hook, and having integrally formed with each end thereof, a depending clamp frame or jaw, with a garment gripper at the lower end thereof, each depending clamp frame or jaw being opposed by another clamp frame or jaw pivoted thereagainst at a mid-point, and furnished at the lower end by a garment gripper engageable against the gripper of the first-mentioned jaw.

An inverted U-spring surrounds the pivot of the two jaws, and has arms which act normally to spread the two jaws apart at the top, whereby the lower ends of the jaws act through their grippers to press the grippers against one another at the bottom. The grippers are opened to receive a garment between them by pressing handle parts by the two jaws together at the top. A guard means is provided to prevent the movable handle part from being squeezed sufficiently to drop the garment when a number of the hangers, with garments suspended thereby, are overcrowded on a single hanger pole.

2 Claims, 4 Drawing Figures

GARMENT HANGER WITH CLAMP GUARD

FIELD OF THE INVENTION

This invention relates generally to plastic garment hangers of the type adapted to spring-clamp and suspend trousers by the cuffs, or skirts by the waistband.

BACKGROUND OF THE INVENTION

Numerous kinds of spring-clamp trousers and skirt hangers are and have been in use for many years. They range in usefulness from poor to reasonably good. Some do not take a sufficiently tight grip on the garment, and the garment is then often found on the floor. Some are difficult to maneuver, some are relatively expensive, some are fragile, some require undue space, etc. One, disclosed in pending application Ser. No. 414,883, filed Nov. 12, 1973, of which I am a co-inventor, is subject to opening slightly when too tightly compacted on a pole. A purpose of the present invention is the provision of an improved quality garment hanger of this class, which avoids all these objections, and which is inexpensively constructed of cheap materials, easily opened, and spring-closed on the garment with sufficient firmness and in such a way as to avoid subsequent dropping of the garment, even when compressed tightly in a group of the hangers hung from a pole. Yet the clamps are easily opened to apply them by squeezing certain handle parts between the thumb and forefinger.

BRIEF DESCRIPTION OF AN ILLUSTRATIVE EMBODIMENT

The invention provides a horizontal, relatively flat hanger beam adapted to hang in a vertical plane from a hook. At each end this beam is an integral, fixed, depending clamp jaw, whose upper end or handle part is displaced laterally a short distance to one side of the vertical medial plane of the hook and beam. Each such fixed clamp jaw mates with a somewhat similar "free" clamp jaw, also furnished with an upper handle part, and disposed somewhat symmetrically on the opposite side of said vertical plane. The two jaws horizontally fulcrum on one another at about their middle. A flat spring in the general form of an inverted U holds the fixed and free jaws together, and acts also to close the jaws. The U-spring goes around the fulcrum parts, and then the two arms thereof extend up between the handles and yieldingly resist inward (jaw closing) pressure on the handle parts, thereby relieving stress to which the handle parts are otherwise subjected.

The handle parts are protected against being squeezed together slightly when in a tight pack of hanger-suspended garments hung from a single pole and so releasing the garment. This is accomplished by a wall means integral with the beam and at right angles thereto, whose edge takes the pressure of the adjacent hanger, and thus guards against this pressure being exerted against its movable jaw and so squeezing it until it drops the garment.

DESCRIPTION OF A PREFERRED EMBODIMENT

Figure 1:
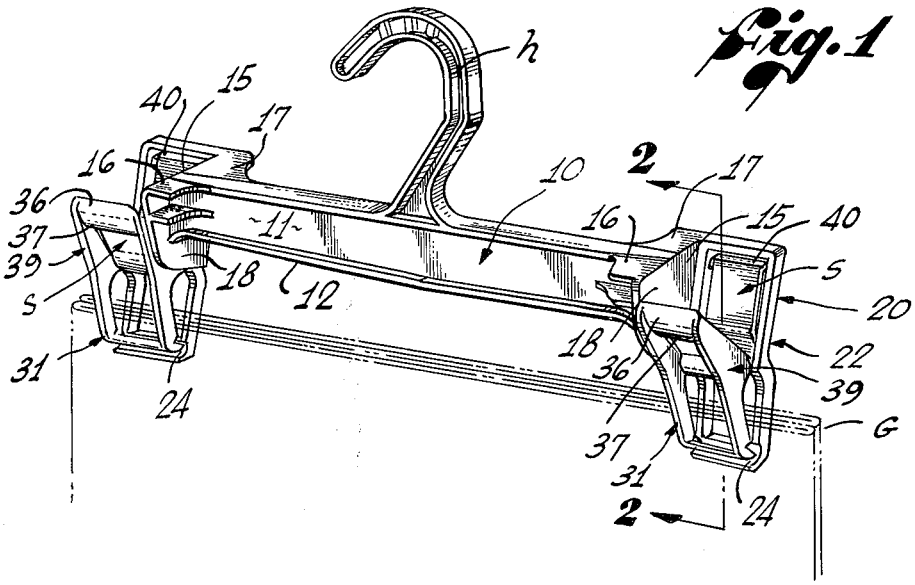
FIG. 1 is a perspective view of a hanger in accordance with the invention.

In the drawings, the hanger is shown to have a horizontal beam 10 occupying a vertical plane, the beam being preferably of I-beam cross section, i.e., comprised of a web 11 edged by a bead or flange 12. Joined integrally to the center of this I-beam is a hook h. Joined integrally to each end of beam 10 is a depending, transverse, vertical end wall 15, extending on opposite sides of the beam. Its upper edge is braced by webs 16 and 17 merging with the beam 10. The depending wall has one side edge 18 converging downwardly to a bottom edge just under the fulcrum area. The opposite side edge 19 of the wall 15 merges integrally with the upper rectangular handle part 20 of an integral clamp jaw 22. The latter converges to the area of the later described fulcrum *f* at substantially the same angle as does the side edge of the end wall 15. Below the fulcrum, the jaw is offset outwardly to a degree, as shown and at its lower end is a concave gripper seat 24.

In the specific embodiment here shown, the upper or handle portion 20 of the jaw comprises two parallel rails 26, surmounted by a top end wall 27 which is a coplanar extension of the aforementioned web 17. Below end wall 27 and between rails 26 is a pocket 28 for an end portion of a presently described U-shaped spring S. Below this pocket 28 the handle is open between the rails 26, down to a transverse cylindrically concave fulcrum member 30 extending transversely between the rails. Below the fulcrum member 30, the lower jaw portion is again open between the rails 26, down to the concave gripper element 24 which extends transversely between the lower extremities of the rails.

Opposed to the jaw 22 is a generally similar or complementary cooperating movable jaw 31, also of generally rectangular form, and possessed of spaced parallel side rails 32, aligned with and opposed to the rails 26, a fulcrum in the preferred form of a pin 34 extending transversely between the rails 26, and with a protruding arcuate surface 36 adapted to engage pivotally or rockably in the concave seat of the fulcrum member 30.

Figure 3:
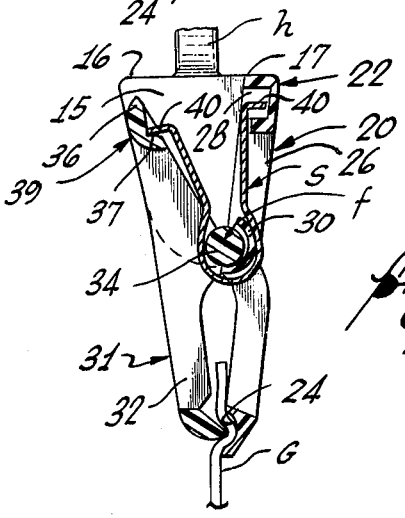
FIG. 3 is a view similar to FIG. 2, but showing the clamp in operation in the position for clamping a garment.
Figure 4:
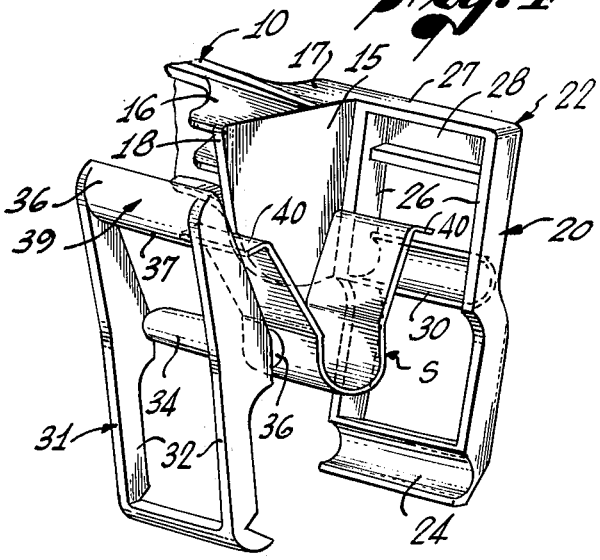
FIG. 4 is an exploded perspective view of the novel clamping parts of the invention.

The lower extremities of the rails 32 carry a transverse toe member 40, opposed to the arcuate seat or pocket 24, and which is designed to enter into said pocket to bind or clamp the uper extremity of the garment G (see FIG. 3).

The rails 32 are open from the toe member 40 to the fulcrum member 34, and again open from the fulcrum member 34 to the transverse top piece 36. This top piece has an indentation 37 to receive and position one of the upper extremities of the U-spring S. The top piece 36 together with the upper portions of the rails 32 comprises the movable handle member 39 of the clamp.

The aforementioned U-spring S is installed from the bottom, making use of the openings between the rails and above and below the fulcrum elements. In the installed position, outwardly bent tabs 40 on its two flaring arms seat in the pocket 28 and the indentation 37. This spring yielding urges the jaws to close at the bottom to grip a garment which has been placed therebetween.

Figure 2:
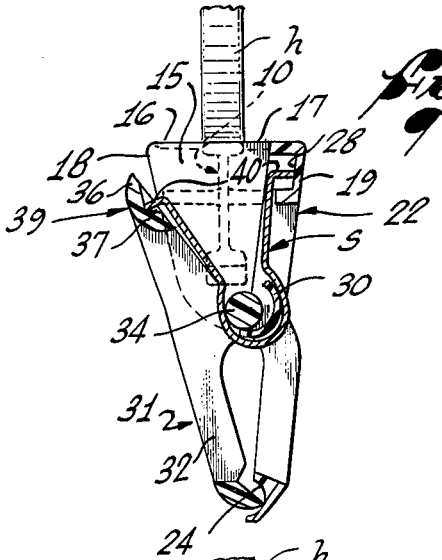
FIG. 2 is a detailed section taken on line 2—2 of FIG. 1, showing the clamp in an inoperative position, i.e., not in operation of clamping a garment.

In the illustrative embodiment, the handle members 39 have been permitted to protrude a short distance beyond the edge 18 of the guard plate 15 when the hanger is not operative (FIG. 2).

The coacting fulcrum parts 30 and 34 may also be somewhat separated at this time. However, when the handles are squeezed together, the fulcrum parts go into interengagement (FIG. 9), and, with the jaws spread by the clamped garment, the movable clamp parts 36 and 39 recede to a position in or substantially inside the edges 18 of the guard plate 15, in a recessed position in which they are immune from further inward squeezing by an adjacent hanger when a number of the hangers are tightly compressed on a hanger pole.

Various changes within the scope of the invention may of course be made without departing from the scope of the appended claims.

What is claimed is:

1. In a garment hanger, the combination of:

a horizontal hanger beam with a hook connected thereto midway of its length;

a relatively fixed clamp jaw integral with and depending from each end of said hanger beam, the lower extremities of said jaws having garment grippers thereon, and said jaws and grippers facing generally perpendicularly and in the same direction from a vertical plane defined by the beam, said jaws having upper end portions comprising handle members;

a clamp jaw pivotal on a horizontal axis parallel to the beam, and including a garment gripper at its lower extremity, opposed to each of said depending fixed jaws, the upper end portions of said pivotal jaws comprising handle members;

a fulcrum element on each fixed jaw intermediate the longitudinal extremities thereof, coaxial with said horizontal axis, interengaging with a coacting fulcrum element in a corresponding position on the corresponding fixed jaw, a U-shaped ribbon spring formed with a medial U-part wrapped once under said interengaging fulcrum elements, and two flaring arms extending upwardly therefrom and bearing against the upper end portions of said handle members from the inside thereof; and a guard wall projecting horizontally from each end of said hanger beam, at right angles thereto, just inwardly of the corresponding pivotal jaw, substantially at least as far as the location of the outermost limit of the handle portion of the pivotal jaw when in garment clamping position.

2. The hanger of claim 1, wherein:

said beam comprises an edge reinforced web disposed normally in substantially a vertical plane, said guard walls comprising vertical walls at the ends of and integral with said beam, said vertical walls having generally downwardly converging lateral bounding edges, and said walls being substantially bi-sected by the beam, said fixed jaws being integral with the corresponding vertical walls along said converging lateral bounding edges thereof, and the lateral bounding edges of said vertical guard walls lying substantially outside as far out as the outermost limit of the handle portion of the pivoted jaw when in garment clamping position.

* * * * *